US008899065B2

(12) United States Patent
Lee

(10) Patent No.: US 8,899,065 B2
(45) Date of Patent: Dec. 2, 2014

(54) REFRIGERATOR WITH ICE MAKER CONTROLLED BY INSTALLATION OF ICE STORAGE BIN

(75) Inventor: Wook Yong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1147 days.

(21) Appl. No.: 12/758,362

(22) Filed: Apr. 12, 2010

(65) Prior Publication Data

US 2010/0257889 A1 Oct. 14, 2010

(30) Foreign Application Priority Data

Apr. 13, 2009 (KR) ..... 10-2009-0031644

(51) Int. Cl.

| | |
|---|---|
| ***F25C 5/18*** | (2006.01) |
| ***F25D 11/02*** | (2006.01) |
| ***F25D 29/00*** | (2006.01) |
| ***F25C 1/24*** | (2006.01) |

(52) U.S. Cl.

CPC . *F25C 1/24* (2013.01); *F25D 11/02* (2013.01); *F25C 5/18* (2013.01); *F25D 29/00* (2013.01)

USPC ..... 62/344; 62/135

(58) Field of Classification Search

USPC ..... 62/131, 135, 344

See application file for complete search history.

(56) References Cited

U.S. PATENT DOCUMENTS

| | | | | |
|---|---|---|---|---|
| 3,146,601 | A * | 9/1964 | Gould | 62/3.6 |
| 3,545,217 | A * | 12/1970 | Linstromberg | 62/137 |
| 6,082,130 | A * | 7/2000 | Pastryk et al. | 62/344 |
| 6,314,745 | B1 * | 11/2001 | Janke et al. | 62/137 |
| 6,722,142 | B1 * | 4/2004 | Pagel | 62/131 |
| 7,832,227 | B2 * | 11/2010 | Wu et al. | 62/344 |
| 2006/0086130 | A1 * | 4/2006 | Anselmino et al. | 62/344 |
| 2007/0204644 | A1 * | 9/2007 | Braun et al. | 62/344 |
| 2008/0053112 | A1 * | 3/2008 | Higashitani et al. | 62/66 |
| 2008/0072610 | A1 * | 3/2008 | Venkatakrishnan et al. | 62/135 |
| 2008/0228318 | A1 | 9/2008 | Roo et al. | |

(Continued)

FOREIGN PATENT DOCUMENTS

| | | | |
|---|---|---|---|
| CN | 1211716 | A | 3/1999 |
| CN | 101169261 | A | 4/2008 |

(Continued)

OTHER PUBLICATIONS

International Search Report issued in Application No. PCT/KR2010/001625, mailed Aug. 16, 2010, 3 pages.

(Continued)

*Primary Examiner* — Cheryl J Tyler
*Assistant Examiner* — David Teitelbaum
(74) *Attorney, Agent, or Firm* — Fish & Richardson P.C.

(57) ABSTRACT

A refrigerator includes a main body that includes a refrigerating chamber and a freezing chamber, a door that selectively shields the refrigerating chamber, and an ice making unit that produces ice. An ice storage unit is provided at the door and stores ice produced in the ice making unit. The ice storage unit includes a housing, a storage basket that is removably coupled to the housing and that stores ice removed from the ice making unit to the ice storage unit, and a sensing apparatus that is provided at the housing and senses attachment or detachment of the storage basket. A controller controls transfer of ice produced by the ice making unit to the storage basket based on output from the sensing apparatus that indicates attachment or detachment of the storage basket.

10 Claims, 16 Drawing Sheets

(56) References Cited

U.S. PATENT DOCUMENTS

| | | | | |
|---|---|---|---|---|
| 2008/0264074 | A1 | 10/2008 | Chase et al. | |
| 2008/0289355 | A1 | 11/2008 | Kang et al. | |
| 2009/0008403 | A1 * | 1/2009 | Lee et al. | 221/89 |

FOREIGN PATENT DOCUMENTS

| | | | |
|---|---|---|---|
| JP | 2005-098602 | A | 4/2005 |
| JP | 2006336969 | A | 12/2006 |
| KR | 2007059486 | A | 6/2007 |
| KR | 2008-0020126 | A | 3/2008 |
| KR | 2008-0026384 | A | 3/2008 |
| KR | 2008026385 | A | 3/2008 |
| KR | 2008-0054983 | A | 6/2008 |

OTHER PUBLICATIONS

International Search Report dated Oct. 22, 2010 for Application No. PCT/KR2010/002263, 3 pages.

Chinese Office Action dated Mar. 21, 2013 for Application No. 201080016225.6, with English Translation, 8 pages.

* cited by examiner

REFRIGERATOR WITH ICE MAKER CONTROLLED BY INSTALLATION OF ICE STORAGE BIN

CROSS-REFERENCE TO RELATED APPLICATIONS

The present application claims priority under 35 U.S.C. 119 and 35 U.S.C. 365 to Korean Patent Application No. 10-2009-0031644 (filed on Apr. 13, 2009), which is hereby incorporated by reference in its entirety.

FIELD

This disclosure relates to refrigerator technology.

BACKGROUND

Generally, a refrigerator includes a plurality of storage chambers for storing content (e.g., food). The storage chambers may include a refrigerating chamber for refrigerating storage and a freezing chamber for freezing storage. One surface of the storage chamber is open such that the content can be taken out from the storage chamber. The storage chamber is opened and closed by a refrigerator door.

Further, the freezing chamber may be provided with an apparatus for producing ice. In the related art, a user should supply water to an ice tray, store the ice tray in the freezing chamber, and then separate ice from the ice tray after a predetermined time elapses.

In other words, the user should perform cumbersome procedures and thus, the convenience of use is reduced.

In addition, in the state where the refrigerator door is opened, a large amount of cool air supplied to the refrigerating chamber is leaked to the outside, such that the freezing efficiency of the refrigerator is reduced.

SUMMARY

In one aspect, a refrigerator includes a main body that includes a refrigerating chamber and a freezing chamber. The refrigerator also includes a door that is configured to open and close at least a portion of the refrigerating chamber and an ice making unit configured to produce ice. The refrigerator further includes an ice storage unit that is provided at the door and that is configured to store ice produced in the ice making unit. The ice storage unit includes a housing, a storage basket that is removably coupled to the housing and is configured to store ice removed from the ice making unit, and a sensing apparatus that is provided at the housing and senses attachment or detachment of the storage basket. In addition, the refrigerator includes a controller configured to control transfer of ice produced by the ice making unit to the storage basket based on output from the sensing apparatus that indicates attachment or detachment of the storage basket.

Implementations may include one or more of the following features. For example, the housing may include a loading part on which the storage basket is loaded and a guide rail that is provided on at least one side of the loading part and guides movement of the storage basket.

In some examples, the sensing apparatus may include a transmitter that is disposed at a first side of the storage basket and transmits a signal and a receiver that is disposed at a second side of the storage basket and receives the signal transmitted from the transmitter. The second side of the storage basket may be opposite of the first side of the storage basket. In these example, the sensing apparatus may include an interruption member that is configured to selectively interrupt the signal transmitted from the transmitter to the receiver.

In some implementations, the sensing apparatus may include a sensor that is provided on at least a part of the storage basket and senses attachment and detachment of the storage basket. In these implementations, the sensing apparatus may include a contact member that is configured to selectively contact the sensor according to whether or not the storage basket is mounted in the housing.

The ice making unit may include an ice maker configured to produce ice and an ice removing motor configured to be driven to remove ice from the ice maker to the ice storage unit. The controller may be configured to selectively drive the ice removing motor based on the output from the sensing apparatus that indicates attachment or detachment of the storage basket.

In some examples, the refrigerating chamber may include a door switch that senses opening and closing of the door. In these examples, the ice making unit may include an ice maker configured to produce ice and an ice removing motor configured to be driven to remove ice from the ice maker to the ice storage unit. The controller may be configured to selectively drive the ice removing motor based on output from the door switch that indicates whether the door is oriented in an open position or oriented in a closed position.

Further, the refrigerator may include a first heat exchanger that is provided at one side of the freezing chamber and configured to produce cool air, and a first blowing fan that moves at least a part of cool air produced by the first heat exchanger to the ice making unit. The refrigerator may include a cooling duct that extends from the freezing chamber to the ice making unit to guide the part of cool air moved by the first blowing fan to the ice making unit.

In some implementations, the refrigerator may include a first heat exchanger configured to produce cool air supplied to the freezing chamber and a second heat exchanger that is provided at the ice making unit and configured to supply cool air to the ice making unit to enable making of ice. The freezing chamber may be disposed below the refrigerating chamber and the freezing chamber and the refrigerating chamber may be partitioned by a barrier. The ice making unit may be disposed in the refrigerating chamber. The ice making unit may be disposed at the door.

In another aspect, a refrigerator includes a main body that includes a refrigerating chamber, a freezing chamber, and one or more heat exchangers. The refrigerator also includes a refrigerating chamber door that is configured to open and close at least a portion of the refrigerating chamber, a freezing chamber door that is configured to open and close at least a portion of the freezing chamber, and an ice maker configured to produce ice based on cool air generated by at least one of the one or more heat exchangers. The refrigerator further includes a storage basket that is configured to store ice produced by the ice maker and that is separably mounted at the refrigerating chamber door and a moving member that is disposed at the refrigerating chamber door and is configured to move according to whether or not the storage basket is mounted at the refrigerating chamber door. In addition, the refrigerator includes a sensor that is configured to sense whether or not the storage basket is mounted at the refrigerating chamber door according to movement of the moving member.

Implementations may include one or more of the following features. For example, the sensor may include a transmitter that transmits a signal and a receiver that is disposed to be spaced from the transmitter and receives the signal transmitted from the transmitter. At least a part of the moving member may be disposed between the transmitter and the receiver. The moving member may include an open portion that allows the signal transmitted from the transmitter to pass through the moving member. When the storage basket is mounted at the refrigerating chamber door, the moving member may contact the sensor.

In yet another aspect, a refrigerator includes a main body that includes one or more heat exchangers, a refrigerating chamber, and a freezing chamber. The refrigerator also includes a refrigerating chamber door that is configured to open and close at least a portion of the refrigerating chamber and an ice maker configured to produce ice based on cool air generated by at least one of the one or more heat exchangers. The refrigerator further includes a storage basket that is separably mounted at the refrigerating chamber door and is configured to store ice produced by the ice maker and an ice removing apparatus that removes ice produced by the ice maker into the storage basket. In addition, the refrigerator includes a sensing apparatus that is configured to sense whether or not the storage basket is mounted at the refrigerating chamber door and a controller configured to control the ice removing apparatus to operate in response to the sensing apparatus sensing that the storage basket is mounted at the refrigerating chamber door and control the ice removing apparatus to stop operation in response to the sensing apparatus sensing that the storage basket is not mounted at the refrigerating chamber door.

Implementations may include one or more of the following features. For example, the refrigerator may include a sensor configured to sense whether the refrigerating chamber door is oriented in an open position or a closed position and the controller may be configured to control the ice removing apparatus to operate in response to the sensing apparatus sensing that the storage basket is mounted at the refrigerating chamber door and the sensor sensing that the refrigerator chamber door is oriented in the closed position.

In some implementations, the refrigerator may include a cooling duct configured to guide air passing through at least one of the one or more heat exchanger to the ice maker and a damper configured to open and close the cooling duct. In these implementations, the controller may be configured to control the damper to close the cooling duct in response to the sensor sensing that the refrigerator chamber door is oriented in the open position.

In some examples, the sensing apparatus may include a moving member that is disposed at the refrigerating chamber door and is configured to move according to whether or not the storage basket is mounted at the refrigerating chamber door. In these examples, the sensing apparatus may include a sensor that is configured to sense whether or not the storage basket is mounted at the refrigerating chamber door according to movement of the moving member.

DETAILED DESCRIPTION

Figure 1:
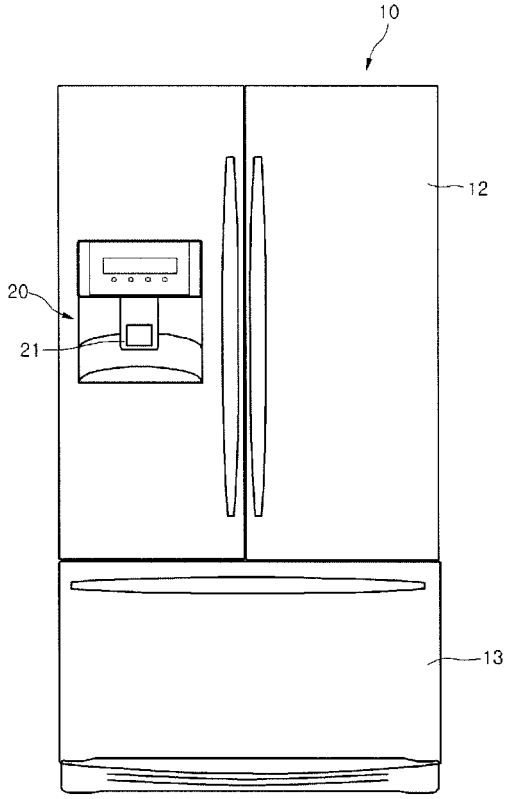
FIG. 1 is a front view showing an external appearance of a refrigerator.
Figure 2:
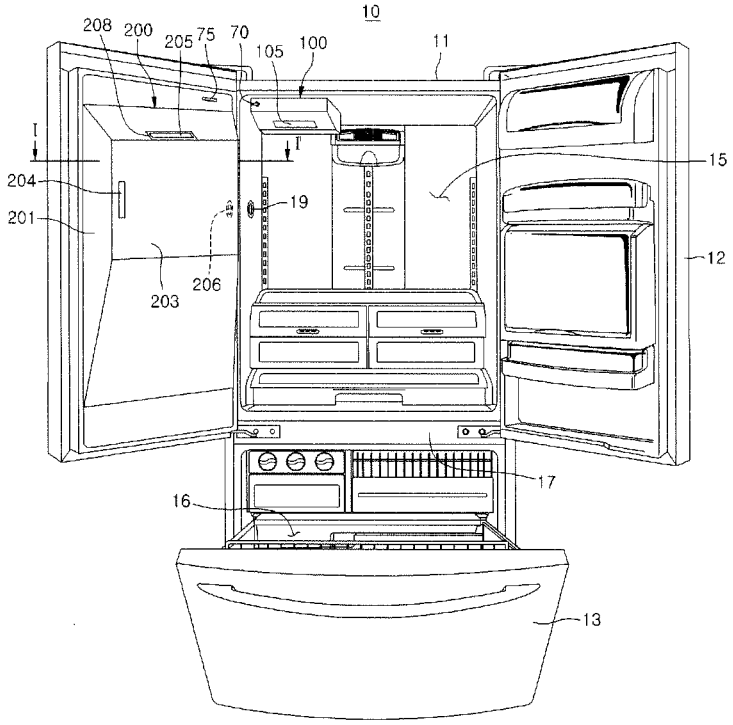
FIG. 2 is a perspective view showing an inner appearance of the refrigerator.
Figure 3:
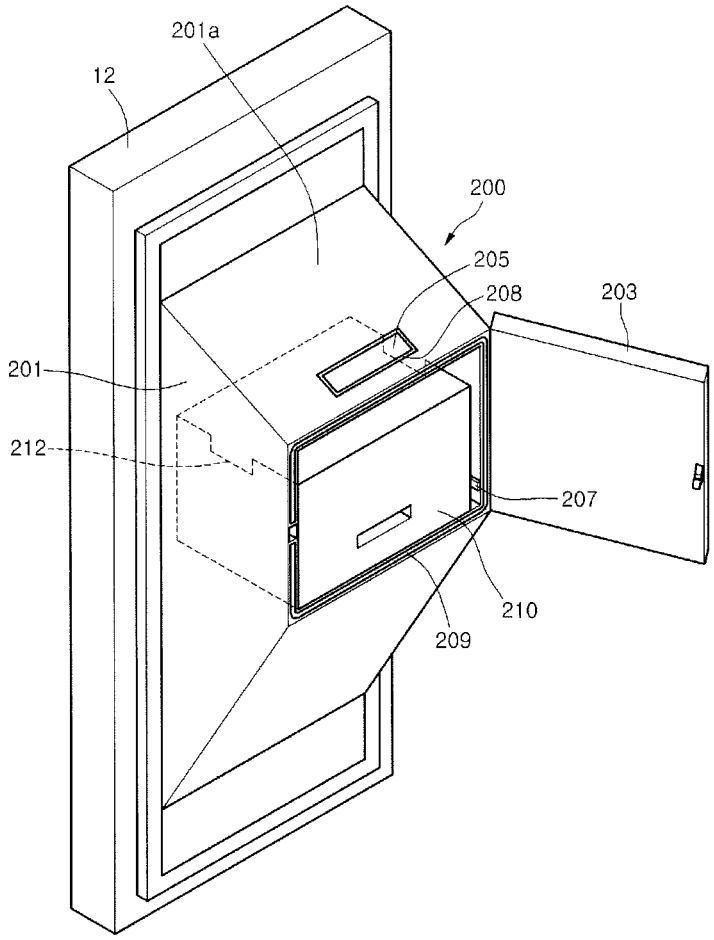
FIG. 3 is a perspective view showing an inner configuration of an ice storage unit.

FIG. 1 illustrates an example of a refrigerator, FIG. 2 illustrates an example interior of the refrigerator shown in FIG. 1, and FIG. 3 illustrates an example of an inner configuration of an ice storage unit.

Referring to FIGS. 1 to 3, a refrigerator 10 includes a refrigerating chamber 15 and a freezing chamber 16 and a main body 11 of which the front surface is opened. The refrigerating chamber 15 is disposed on the upper part of the freezing chamber 16. The refrigerating chamber 15 and the freezing chamber 16 may be partitioned by a barrier rib 17.

In addition, the refrigerator 10 includes a refrigerating chamber door 12 that is rotatably coupled to the front of the refrigerating chamber 15 and a freezing chamber door 13 that is drawably provided to the front of the freezing chamber 16. Herein, the refrigerating chamber 15 can be opened and closed by a plurality of refrigerating chamber doors 12.

One or more refrigerating chamber doors of the plurality of refrigerating chamber doors 12 include a dispenser apparatus 20 that can be operated to dispense water or ice. The dispenser apparatus 20 includes a pressing part 21 that can be pressed to cause dispensing of water or ice.

In addition, an ice making unit 100 to produce ice is provided at the main body 11. The ice making unit 100 may be disposed on one side of an upper end part of the refrigerating chamber 15 and an ice discharging hole 105 is defined at the front surface of the ice making unit 100 in order to discharge ice produced in the ice making unit 100.

Meanwhile, at least a part of the front surface of the ice making unit 100 may be inclined downward. In this case, the ice discharging hole 105 may be defined on an inclined surface of the front surface of the ice making unit 100.

However, various implementations with regard to the shape and position of the ice discharging hole 105 may be proposed. Although not shown in the drawings, the ice discharging hole 105 may be defined on a lower surface of the ice making unit 100, thereby discharging ice downward.

Any one of the plurality of refrigerating doors 12 is provided with an ice storage unit 200 that stores ice discharged from the ice making unit 100. The ice storage unit 200 is disposed at an inner side of the refrigerating chamber door 12 and is communicated with the ice making unit 100 in the state where the refrigerating chamber door 12 is closed.

The ice storage unit 200 includes a housing 201 that defines an external appearance, a door 203 that is rotatably coupled to the front of the housing 201, and a storage basket 210 that is drawably received in the housing 201. Herein, the housing 201 may be made of a material having high heat insulating property that reduces (e.g., minimizes) heat exchange between the refrigerating chamber 15 and the inside of the ice storage unit 200.

The housing 201 has an ice injecting hole 205 that communicates ice discharged from the ice discharging hole 105 into the inside of the ice storage unit 200. The ice injecting hole 205 may be defined at a size corresponding to the ice discharging hole 105.

The edge part of the ice injecting hole 205 may be provided with a gasket 208 that reduces (e.g., prevents) cool air from leaking in the state where the ice injecting hole 205 is closely attached to the ice discharging hole 105. Although not shown in the drawings, the edge part of the ice discharging hole 105 may be provided with the gasket.

The upper surface of the housing 201 has a coupling surface 201*a* that is inclined to correspond to the front surface of the ice making unit 100. When the refrigerating chamber door 12 is closed, the inclined front surface of the ice making unit 100 can be closely attached to the coupling surface 201*a* to correspond to each other. The coupling surface 201*a* may include the ice injecting hole 205.

However, various implementations with regard to the shape of the coupling surface 201*a* can be proposed. Although not shown in the drawings, when the ice discharging hole 105 is defined on the lower surface of the ice making unit 100, the coupling surface 201*a* may be horizontal (e.g., not inclined), corresponding to the lower surface of the ice making unit 100. In this example, the ice injecting hole 205 is defined on the horizontal coupling surface 201*a*.

The door 203 has a grippable door handle 204 in order to open the door 203. The door handle 204 may be depressedly positioned in the door 203. The door 203 is provided with a hanging hook that is hooked to the housing 201 and the housing 201 may be have a hooking groove at a position corresponding to the hanging hook.

The opened front surface edge of the housing 201 may be provided with a sealing member 209 that reduces (e.g. prevents) cool air inside the ice storage unit 200 from leaking. In the state where the door 203 is closed, the housing 201 can be closely attached to the door 203 by the sealing member 209.

Other implementations are proposed. In FIGS. 1-3, the ice storage unit 200 is configured by the coupling of the housing 201 and the door 203, but as described in U.S. Pat. No. 7,469,553, a structure that includes a first ice storage member and a second ice storage member to store and dispense ice can be applied. In this case, any one of the first ice storage member and the second ice storage member can be separably provided.

Meanwhile, one side of the housing 201 has a cool air discharging hole 206 that discharges cool air supplied to the ice storage unit 200. In other words, the cool air flowing to the ice storage unit 200 from the ice making unit 100 can be discharged through the cool air discharging hole 206.

The main body 11 has a cool air injecting hole 19 into which the cool air discharged from the cool air discharging hole 206 is injected. The cool air injecting hole 19 may be defined at a position that is communicated with the cool air discharging hole 206 in the state where the refrigerating chamber door 12 is closed. The cool air injected through the cool air injecting hole 19 may flow to the freezing chamber 16 through a duct positioned in a sidewall of the refrigerator 10.

Meanwhile, the ice making unit 100, which senses whether the refrigerating chamber door 12 is opened or closed, may be provided with a door switch 70. The door switch 70 may protrude forward from the front surface of the ice making unit 100.

The refrigerating door 12 is provided with a switch pressing part 75 that contacts the door switch 70 in the state where the refrigerating chamber door 12 is closed. The switch pressing part 75 protrudes from the rear surface of the refrigerating chamber door 12.

Although the drawings show the case where the door switch 70 is provided at the ice making unit 100, it may be disposed at the lower part or one side surface of the storage chamber 15.

The switch pressing part 75 may be disposed at the lower part or one side surface of the refrigerating chamber door 12 according to the position of the door switch 70. In some implementations, the switch pressing part 75 may be omitted and the refrigerating chamber door 12 can be configured to directly press the switch 70.

Hereinafter, the configuration of the ice storage unit 200 will be described in detail with reference to the drawings.

Figure 4:
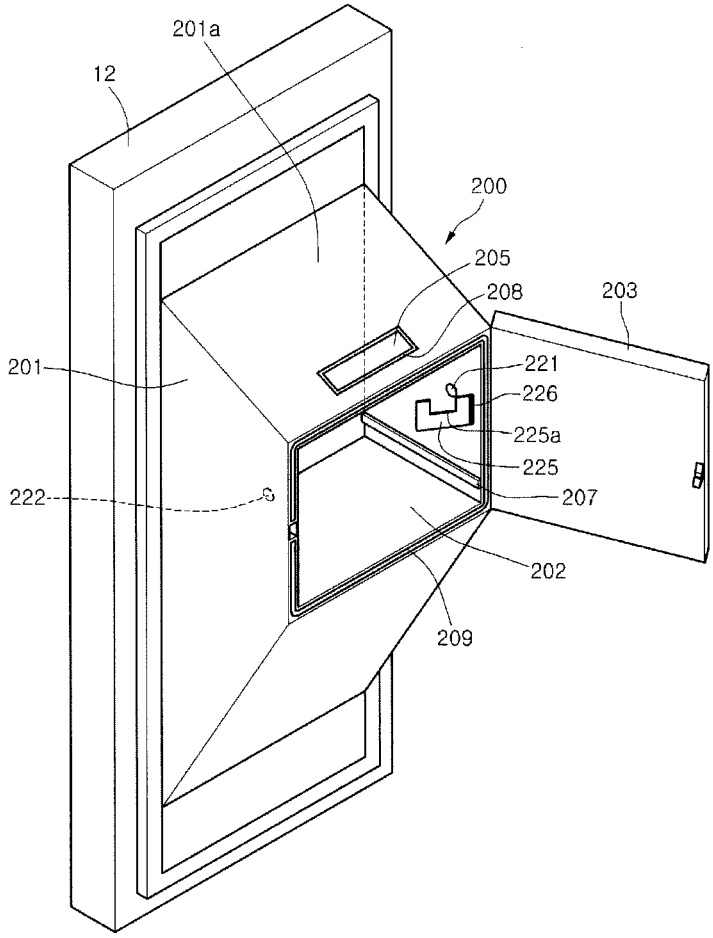
FIG. 4 is a perspective view showing an inner configuration of a housing.
Figure 5:
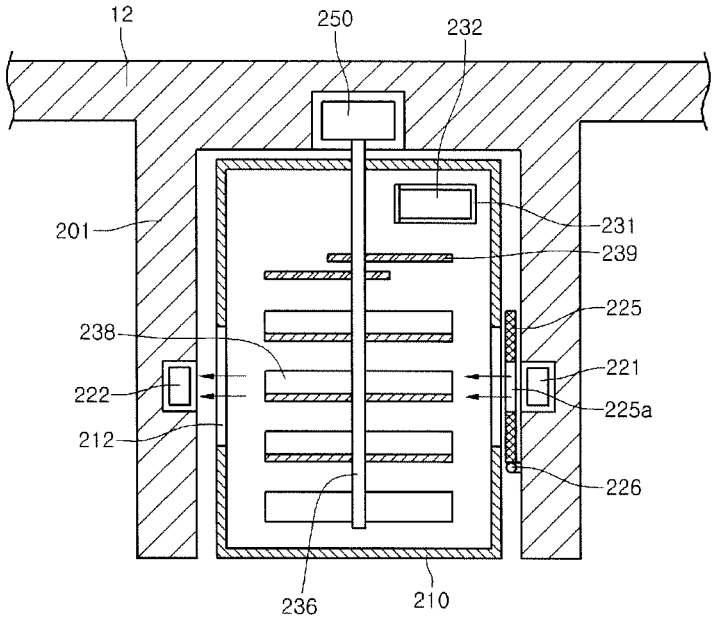
FIG. 5 is a cross-sectional view taken along line I-I' of FIG. 2.
Figure 6:
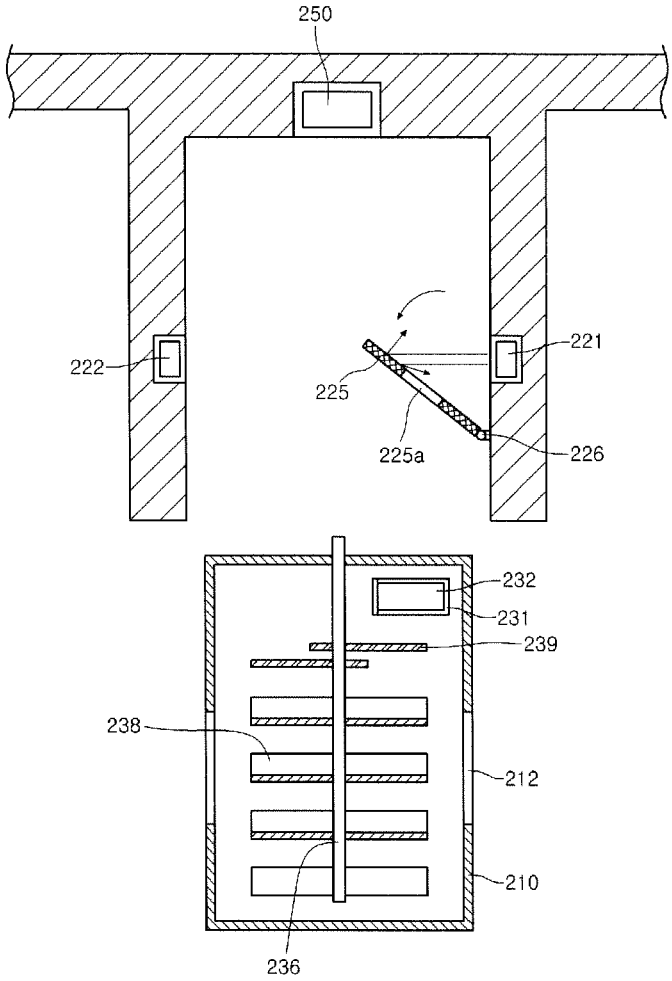
FIG. 6 is a cross-sectional view showing an appearance where a storage basket is separated.

FIG. 4 illustrates an example of an inner configuration of the housing, FIG. 5 is a cross-sectional view taken along line I-I' of FIG. 2, and FIG. 6 illustrates an example where the storage basket is separated.

Referring to FIGS. 4 to 6, the ice storage unit 200 includes a housing 201 that is provided inside the refrigerating chamber door 12, a door 203 that selectively shields the front of the housing 201, and a storage basket 210 that is received in the housing 201 and is drawably provided forward.

The storage basket 210 has a rectangular parallelepiped shape of which the upper surface is opened. One side surface of the storage basket 210 has a depression part 212 (see FIG. 3). The depression part 212 is depressed downward from the upper ends of the left side surface and right side surface of the storage basket 210, respectively.

The inner side surface of the housing 201 has a guide rail 207 that guides the draw in and out of the storage basket 210. A plurality of guide rails 207 may be provided at both sides of the housing 201. However, the guide rail 207 is not limited to any one position and unlike the one shown in the drawings, may be provided at the lower side surface of the housing 201.

The storage basket 210 may be provided with a guide part at a position corresponding to the guide rail 207. The guide part may move along the guide rail 207 while the storage basket 210 is drawn out.

Other implementations are proposed. The storage basket can be configured to be tilted in one direction and then drawn out. To this end, the storage basket may be provided with guide protrusions and the housing may be provided with the guide rails. The configuration thereof is disclosed in U.S. Pat. No. 7,469,553.

In addition, the inside of the housing 201 is provided with a loading part 202 that loads the storage basket 210. The storage basket 210 can be drawn in the inside of the housing 201 in the state where it is loaded in the loading part 202. The guide rail 207 may be provided at both sides of the loading part 202.

Both side walls of the housing 201 are provided with sensors 220 (see FIG. 8) as a sensing apparatus that senses the coupling or not of the storage basket 210. The sensor 220 includes a transmitter 221 that is provided on one side wall of the housing 201 and transmits light (signal) and a receiver 222 that is provided on the other side wall of the housing 201 and receives light (signal) transmitted from the transmitter 221.

In the state where the storage basket 210 is coupled inside the housing 201, the transmitter 221 and the receiver 222 may have a position corresponding to the depression part 212 of the storage basket 210, that is, at one side and the other side of the storage basket 210.

In addition, one side of the transmitter 221 is provided with an interruption member 225 (referred to as a moving member) that interrupts signals transmitted from the transmitter 221. The interruption member 225 has a cutting part 225*a* that is depressed in one direction. The transmitter 221 may be positioned at one side of the cutting part 225*a*.

The transmitter and the receiver may be collectively referred to as a sensor.

Although FIG. 4 shows the case that the cutting part 225*a* is depressed downward from the upper end of the interruption member 225, the cutting part 225*a* may be depressed from the lower end or one side surface of the interruption member 225 or may be a hole shape that penetrates through an approximately central part of the interruption member 225 In other words, any shape of the interruption member 225 may be used.

Although FIGS. 4-6 illustrate a case where the interruption member 225 is provided at one side of the transmitter 221, it may be provided at one side of the receiver 222 and may be provided at each of the transmitter 221 and the receiver 222.

The interruption member 225 may rotatably coupled to the housing 201. One side of the interruption member 225 is provided with a first spring 226 so that the interruption member 225 is elastically coupled to the housing 201.

The first spring 226 may be a torsion spring so that the interruption member 225 can be rotated by a predetermined range.

The storage basket 210 includes an outlet 231 through which the stored ice passes to be dispensed and a shutter 232 that selectively shields the outlet 231. When the pressing part 21 is pressed, the shutter 232 can be rotated in order to open the outlet 231.

Further, the inside of the storage basket 210 is provided with an auger 238 that is rotatably provided in order to move the stored ice to the outlet 231 side, an ice crusher 239 that is provided at one side of the auger 238 to crush ice at an appropriate size and a rotating shaft 236 that provides a rotation center of the auger 238. The rotation shaft 236 transfers turning force to the auger 238 and the ice crusher 239.

The refrigerating chamber door 12 is provided with a motor 250 that provides driving force to rotate the rotating shaft 236. When the storage basket 210 is coupled to the housing 201, the rotating shaft 236 may be connected to the motor 250.

When the motor 250 is driven, the ice of the storage basket 210 is transferred to the outlet 231 direction by the auger 238 and is crushed by the ice crusher 239, which can be discharged through the outlet 231.

Meanwhile, although the storage basket 210 can be configured so that the auger 238 and the ice crusher 239 is vertically disposed to the door 12 (see FIG. 7), unlike this, it can be configured so that the auger 238 and the ice crusher 239 are disposed in up and down directions, that is, in a direction parallel with the door 12. This configuration is already disclosed in U.S. Pat. No. 6,082,130.

Moreover, the auger 238 and the ice crusher 239 may be inclinedly disposed at a predetermined angle to the door 12. This configuration is previously disclosed in Korean Laid-Open Patent 2008-0052503. Of course, various implementations with regard to the inclined angle or the direction of the auger 238 and the ice crusher 239 can be easily proposed.

Hereinafter, the operation related to the attachment and detachment of the storage basket 210 will be described.

While the storage basket 210 is coupled to the housing 201, the storage basket 210 presses the interruption member 225. Then, the interruption member 225 overcomes the elastic force of the first spring 226 and is rotated to the inside wall of the housing 201.

In other words, as shown in FIG. 5, the interruption member 225 is disposed forward and backward in the state where it is interposed between the storage basket 210 and the housing 201.

At this time, the transmitter 221 is positioned at one side and the depression part 212 of the storage basket 210 is positioned at the other side, based on the cutting part 225*a* of the interruption member 225. In other words, the signals transmitted from the transmitter 221 may move in the inner direction of the storage basket 210 through an empty space that is defined in the cutting part 225*a* and the depression part 212.

The signals transmitted from the transmitter 221 may be received in the receiver 222. Herein, one side of the receiver 222 corresponds to another depression part 212 of the storage basket 210 and the signals of the transmitter 221 may be received in the receiver 222 through the depression part 212.

Consequently, the signals transmitted from the transmitter 221 may be received in the receiver 222. The signals received in the receiver 222 are transferred to the controller 300 (see FIG. 8) and the controller 300 can recognize the coupling of the storage basket 210.

Therefore, the controller 300 can control the ice removal in the ice making unit 100.

Also, while the storage basket 210 is drawn out, the rotating shaft 236 can be separated from the motor 250.

When the storage basket 210 is completely drawn out to remove force pressing the interruption member 225, the interruption member 225 is applied with the restoring force of the first spring 226, such that it can be rotated in a predetermined direction. Referring to FIG. 6, the interruption member 225 can be rotated counterclockwise based on the first spring 226.

At this time, the signals transmitted from the transmitter 221 to the receiver 222 are interrupted by the interruption member 225. In other words, the signals are reflected by the interruption member 225, such that they are not transmitted to the receiver 222.

When the signals are not transmitted to the receiver 222, the controller 300 recognizes the draw out of the storage basket 210 and thus, can perform a control to stop ice being discharged from the ice making unit 100 to the storage basket 210. In some implementations, the sensor 220 including the transmitter 221 and the receiver 222 can sense whether ice is fully filled in the inside the storage basket 210. In this case, the interruption member 225 may not be provided.

When the height of ice stored in the storage basket 210 reaches the height of the transmitter 221 and the receiver 222, the signals transmitted from the transmitter 221 are interfered or reflected by the surface of ice and thus, are not transmitted to the receiver 222.

At this time, the controller 300 senses the full ice of the storage basket 210 and thus, can perform a control to stop ice being discharged from the ice making unit 100 to the storage basket 210.

A reference determining whether ice is fully filled in the storage basket 210 can be changed according to the installation height of the transmitter 221 and the receiver 222.

Figure 7:
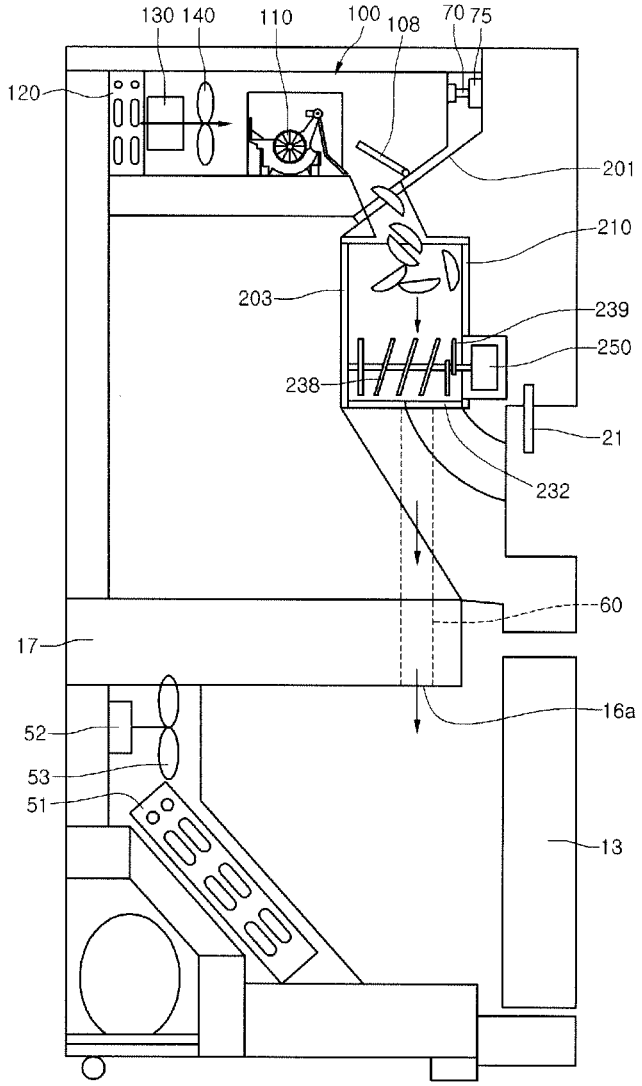
FIG. 7 is a diagram showing an operation of the refrigerator.

FIG. 7 illustrates an example of the operation of the refrigerator. Referring to FIG. 7, a rear side of the freezing chamber 16 is provided with a first heat exchanger 51 that produces cool air to be supplied to the freezing chamber 16 and a first fan motor 52 and a first blowing fan 53 that blow the cool air produced from the first heat exchanger 51 to the freezing chamber 16.

Moreover, the ice making unit 100 includes an ice maker 110 that produces ice from supplied water, a second heat exchanger 120 that is provided at one side of the ice maker 110 and produces cool air by being heat-exchanged with outer air, and a second fan motor 130 and a second blowing fan 140 that blow the cool air produced in the second heat exchanger 120 to the ice maker 110 side.

The ice maker 100 includes an ice tray that is supplied with water and produces ice in a predetermined shape and an ice removing motor 115 (see FIG. 8) that is driven to remove ice from the ice tray. The ice tray may be provided with a predetermined heater to separate ice.

When the ice removing motor 115 is driven, ice separated from the ice tray is discharged through the ice discharging hole 105 and drops to the storage basket 210 side and is stored therein.

Meanwhile, the ice making unit 100 is provided with an outlet control unit 108 that selectively shields the ice discharging hole 105. The outlet control unit 108 removes ice in the ice maker 110 and is opened while ice is discharged to the ice storage unit 200 and can be controlled to be shielded in the state when the ice removal is not performed.

Although not shown in the drawings, the outlet control unit 108 may be provided at the ice storage unit 200, such that it can be provided to selectively shield the ice injecting hole 205.

When the user presses the pressing part 21, the outlet 231 is opened while the shutter 232 is rotated and ice can be discharged to the outside through the dispenser apparatus 20.

Meanwhile, the cool air supplied to the ice maker 110 can be injected to the freezing chamber 16 through the ice storage unit 200. In detail, a return duct 60 is provided between the cool air injecting hole 19 defined in the refrigerating chamber 15 and the freezing chamber 16.

The return duct 60 is extended penetrating through the barrier rib 17 from one side wall of the refrigerating chamber 15. The cool air flowing through the return duct 60 is injected into the freezing chamber 16 through the freezing chamber injecting part 16*a*.

In other words, one side end of the return duct 60 communicates with the cool air injecting hole 19 and the other side end communicates with the cool air injecting part 16*a*.

In some examples, the cool air passing through the ice maker 110 cools the storage basket 210, is injected into the return duct 60 through the cool air discharging hole 206 and then, may be injected into the freezing chamber 16 through the freezing chamber injecting part 16*a*.

Figure 8:
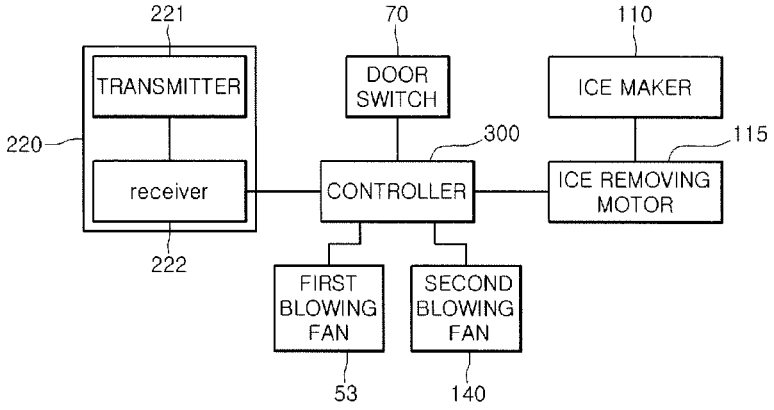
FIG. 8 is a block diagram showing a configuration of the refrigerator.

FIG. 8 illustrates an example configuration of the refrigerator. Referring to FIG. 8, the refrigerator 10 includes the first blowing fan 53 that blows cool air to the freezing chamber 16 and the second blowing fan 140 that blows cool air to the ice making unit 100, the sensor 220 that is provided at the refrigerating chamber door 12 and senses the attachment or detachment or the full ice or not of the storage basket 210, the door switch 70 that senses the opening or closing of the refrigerating chamber door 12, the ice removing motor 115 of which the driving is controlled according to the attachment or detachment or the full ice or not of the storage basket 210, the ice maker 110 that selectively performs the ice removal according to the driving of the ice moving motor 115, and the controller 300 that is connected to the components and controls the operation of the refrigerator.

In detail, the first blowing fan 53 and the second blowing fan 140 are separately controlled by the controller 300, such that cool air can be supplied to the freezing chamber 16 and the ice making unit 100, respectively.

The sensor 220 includes the transmitter 221 and the receiver 222 that transmits and receives signals. When the signals transmitted from the transmitter 221 are transmitted to the receiver 222, it can be determined to be the state where the storage basket 210 is coupled. In addition, when the signals transmitted from the transmitter 221 are transmitted to the receiver 222, it is determined to be the state where the full ice of the storage basket 210 is not performed, such that the ice removal from the ice maker 110 can be controlled to be performed.

On the other hand, when the signals transmitted from the transmitter 221 are transmitted to the receiver 222, it can be determined to be the state where the storage basket 210 is separated. In addition, when the signals transmitted from the transmitter 221 are not transmitted to the receiver 222, it is determined to be the state where the full ice of the storage basket 210 is performed, such that the ice removal from the ice maker 110 can be controlled to be stopped.

Meanwhile, when the closure of the refrigerating chamber door 12 is recognized by the door switch 70, the driving of the second blowing fan 140 is maintained so that the cool air can be supplied to the ice making unit 100 and the ice removal toward the ice storage unit 200 from the ice maker 110 can be performed.

On the other hand, when the opening of the refrigerating chamber door 12 is recognized by the door switch 70, the driving of the second blowing fan 140 stops and thus, the supply of cool air to the ice making unit 100 stops, thereby making it possible to reduce (e.g., minimize) cool air from leaking to the outside of the refrigerator.

The ice removal from the ice maker 110 is controlled to be stopped, thereby making it possible to reduce (e.g., prevent) the phenomenon that ice is discharged from the ice maker 110 to the outside of the refrigerator.

In some implementations, a different structure that senses the detachment and attachment of the storage basket 210 may be used. Therefore, the differences in structure are described, while the like portions are labeled with like reference numerals to those described above.

Figure 9:
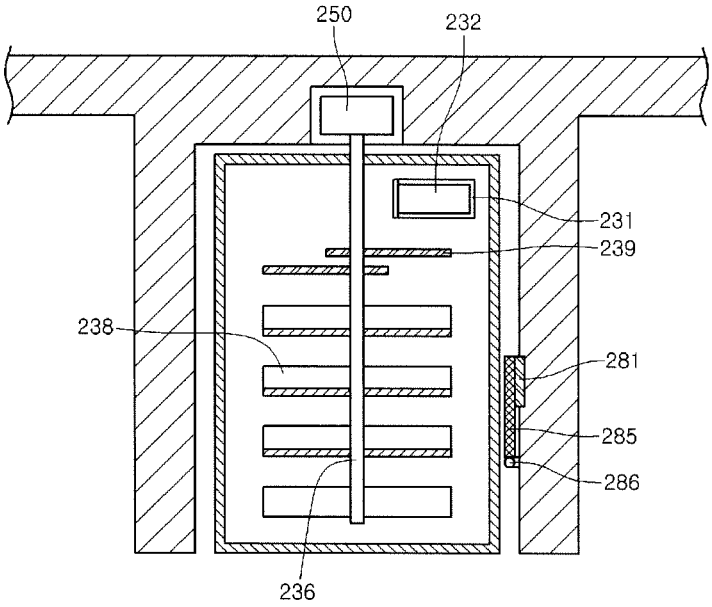
FIG. 9 is a cross-sectional view showing a configuration of an ice storage unit.
Figure 10:
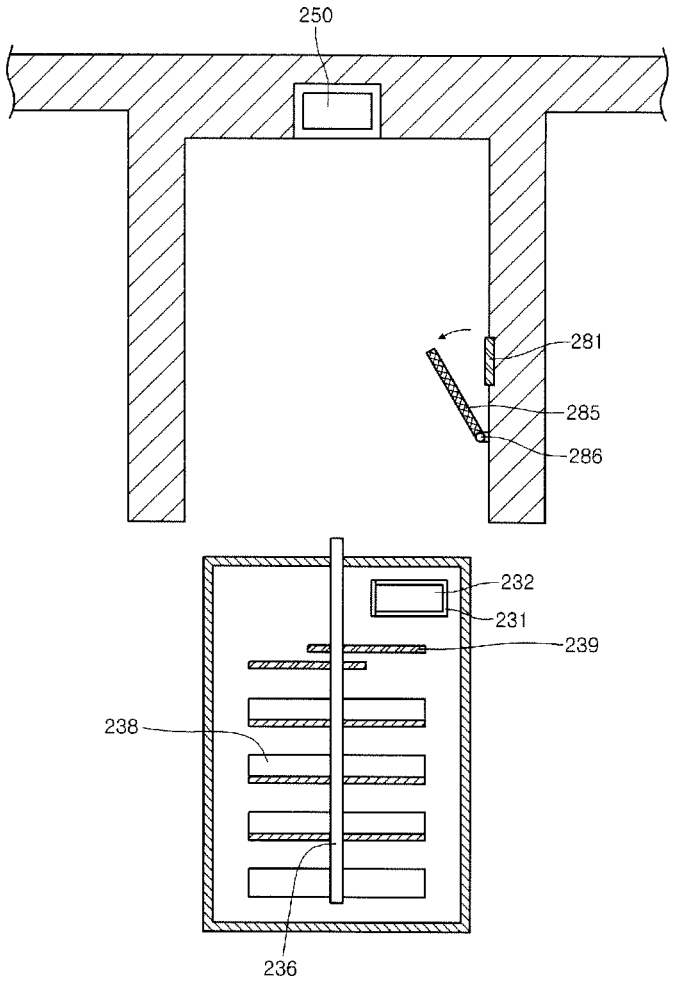
FIG. 10 is a cross-sectional view showing an appearance where a storage basket is separated.

FIG. 9 illustrates an example of a configuration of the ice storage unit and FIG. 10 illustrates an example where the storage basket is separated.

Referring to FIGS. 9 and 10, the refrigerating chamber door 12 includes an ice storage unit 200 that stores ice. The ice storage unit 200 includes a housing 201 that defines an inner space for receiving a storage basket 210.

The inner side of the housing 201 is provided with a sensor 281 that senses the attachment or detachment of the storage basket 210. The sensor 281 may be exposed to the outside in the state where it is coupled to the housing 201. Herein, the sensor 281 may include a switch.

Although the drawings show the case where the sensor 281 is provided only at one side of the storage basket 210, the sensor 281 may be provided at both sides (left and right side) of the storage basket 210 or a rear side of the storage basket 210.

One side of the sensor 281 is provided with a contact member 285 (referred to as a moving member) that selectively contacts the sensor 281 according to the drawing in and out of the storage basket 210. The contact member 285 may be rotatably coupled to the housing 201.

Herein, a switch structure, which is electrically conducted by the contact, can be applied to the sensor 281 and the contact member 285 and may be collectively referred to as a sensing apparatus.

One side of the contact member 285 is provided with a second spring 286 for the elastic movement of the contact member 285. The contact member 285 can be coupled to the inside wall of the housing 201 by the second spring 286.

The operation and the attachment and detachment sensing operation of the storage basket will be described.

First, in the state where the storage basket 210 is coupled to the housing 201, the contact member 285 is interposed between one side surface of the storage basket 210 and the inner side surface of the housing 201. As shown in FIG. 9, the contact member 285 is disposed forward and backward.

At this time, the contact member 285 is pressed by the storage basket 210 and the restoring force of the second spring 286 can be offset by the pressed force.

In the state where the storage basket 210 is drawn in the housing 201, the contact member 285 contacts the sensor 281 and, thus, the sensor 285 can sense the coupling state of the storage basket 210.

The sensing signals of the sensor 285 are transmitted to the controller 300 and the controller 300 can control the operation of the refrigerator according to the coupling of the storage basket 210. The contents of the operation of the refrigerator are the same as described above.

Meanwhile, when the storage basket 210 is separated from the housing 201, the contact member 285 is rotated in a predetermined direction by the restoring force of the second spring 286. As shown in FIG. 10, the contact member 285 can be rotated counterclockwise.

When the contact member 285 is rotated, the contact member 285 is separated from the sensor 281 and, thus, the sensor 281 disconnects the signals by the contact member 285.

Thereby, the sensor 281 senses the separation of the storage basket 210 and transmits it to the controller 300. The controller 300 can operate the refrigerator according to the separation of the storage basket 210. The contents of the operation of the refrigerator are the same as described above.

In some examples, a different cool air supplying structure may be used. Therefore, the differences are described, while the like portions are labeled with like reference numerals to those described above.

Figure 11:
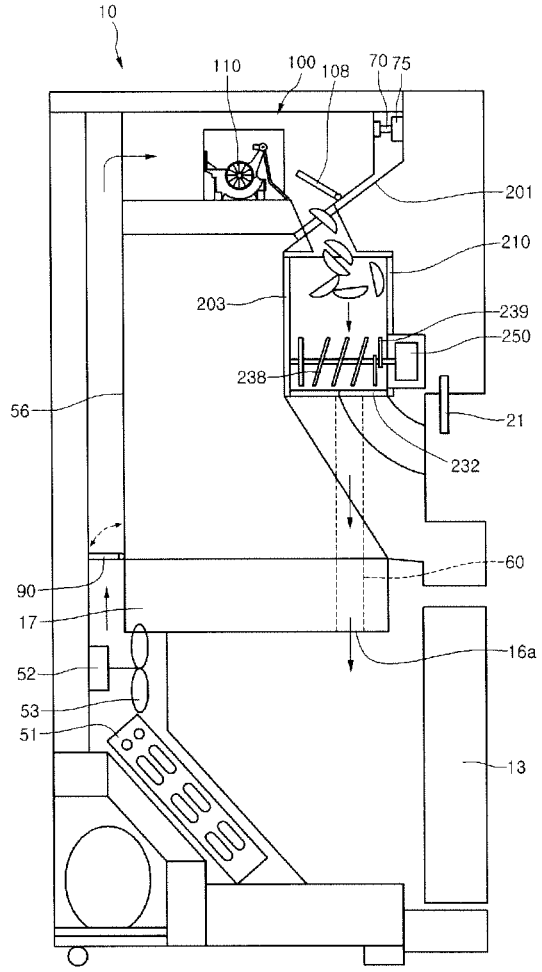
FIG. 11 is a diagram showing a configuration of a refrigerator.
Figure 12:
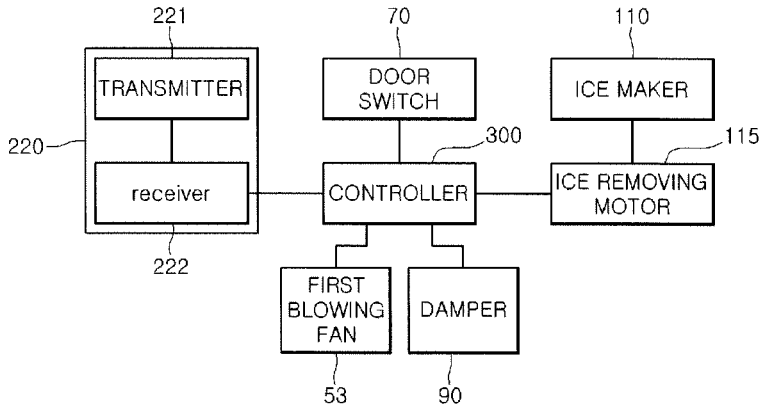
FIG. 12 is a block diagram showing a configuration of the refrigerator.

FIG. 11 illustrates an example of a configuration of a refrigerator and FIG. 12 illustrates an example of a configuration of the refrigerator.

Referring to FIGS. 11 and 12, the refrigerator 10 includes the first heat exchanger 51 that produces cool air by being heat-exchanged with outer air and the first blowing fan 53 and the first fan motor 52 that blows the cool air produced in the first heat exchanger 51 to the freezing chamber 16.

One side of the first blowing fan 53 is extended to the refrigerating chamber 15 and is provided with the cooling duct 56 into which at least a part of the cool air produced in the first heat exchanger 51 flows. The cooling duct 56 is provided at the rear side of the barrier rib 17 that partitions the refrigerating chamber 15 and the freezing chamber 16 and may be extended to the ice making unit 100 side.

At least a part of the barrier rib 17 can be opened so that the cool air produced in the freezing chamber 16 can move to the refrigerating chamber 15.

One side of the cooling duct 56 is provided with a damper 90 that selectively interrupts the flow of the cool air.

In the state where the damper 90 is opened, at least a part of the cool air generated in the first heat exchanger 51 may flow into the ice making unit 100 through the cooling duct 56. The cool air flowing into the ice making unit 100 is used for making ice and passes through the ice storage unit 200 and can be returned to the freezing chamber 16 through the return duct 60.

In the state where the damper 90 is closed, the cool air flows into the freezing chamber 16 and does not flow into the cooling duct 56. Consequently, the cool air does not flow to the ice making unit 100 and the ice storage unit 200.

The first blowing fan 53 and the damper 90 can be controlled by the controller 300.

When the refrigerating chamber door 12 is opened, the damper 90 closes the cooling duct 56. Therefore, the cool air flowing into the cooling duct 56 is interrupted and the supply of cool air to the ice making unit 100 and the ice storage unit 200 can be stopped. Consequently, in the state where the refrigerating chamber door 12 is opened, the phenomenon that the cool air is unnecessarily leaked to the outside of the refrigerator can be reduced (e.g., prevented).

When the refrigerating chamber door 12 is closed, the damper 90 is opened and, as described above, the cool air can flow into the ice making unit 100.

Meanwhile, the contents related to the ice removal in the ice maker 110 according to the attachment or detachment of the storage basket 210 is the same as described above.

In some implementations, the disposition of the ice making unit may be different. Therefore, the differences are described below, while the like portions are labeled with like reference numerals to those described above.

Figure 13:
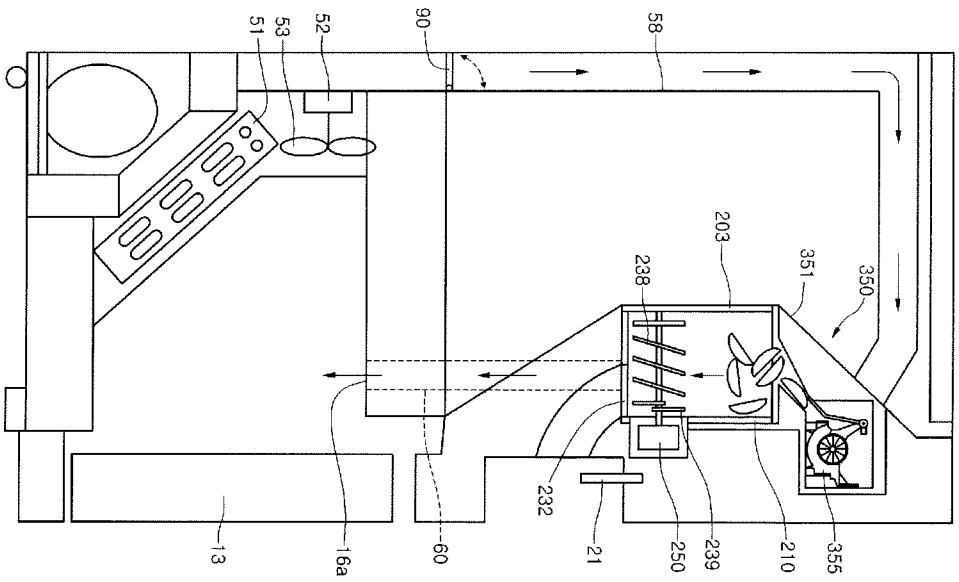
FIG. 13 is a diagram showing a configuration of a refrigerator.

FIG. 13 illustrates a configuration of a refrigerator. Referring to FIG. 13, the refrigerating chamber door 12 is provided with an ice maker 355 that produces ice and an ice making unit 350 including the storage basket 210 that stores ice produced in the ice maker 355.

The ice making unit 350 includes a housing 351 that protrudes from the inner side surface of the refrigerating chamber door 12 and a door that selectively shields the housing 351. The ice maker 355 and the storage basket 210 are received in the housing 351.

The refrigerating chamber 15 is provided with the cooling duct 58 into which the cool air generated in the freezing chamber 16 flows. The cooling duct 58 is extended from one side of the freezing chamber 16 to the refrigerating chamber 15 side through the barrier rib 17.

Herein, the cooling duct 58 can be configured to be extended upward from the rear side of the refrigerating chamber 15, to be bent forward, and to be communicated with the ice maker 355.

In addition, the cooling duct 58 is provided with the damper 90 that selectively interrupts the flow of the cool air. The damper 90 is rotatably coupled to one side of the cooling duct 58 and shields the inner space of the cooling duct 58, thereby making it possible to interrupt the flow of the cool air.

The cool air produced in the first heat exchanger 51 flows into the freezing chamber 16 by the blowing fan 53 and at least a part of the cool air can be supplied to the ice maker 355 through the cooling duct 58.

When the refrigerating chamber door 12 is opened, the door opening signal is transmitted to the controller 300 by the door switch 70 and the controller 300 rotates the damper 90 to interrupt the flow of the cool air. Then, the supply of cool air to the ice maker 355 stops, such that the phenomenon that the cool air is unnecessarily leaked to the outside of the refrigerator through the opened door can be reduced (e.g., prevented).

In the state where the refrigerating chamber door 12 is closed, the damper 90 is controlled to be opened. The cool air is supplied to the ice maker 355 and the storage basket 210 and then is returned to the freezing chamber 16 through the return duct 60.

Figure 14:
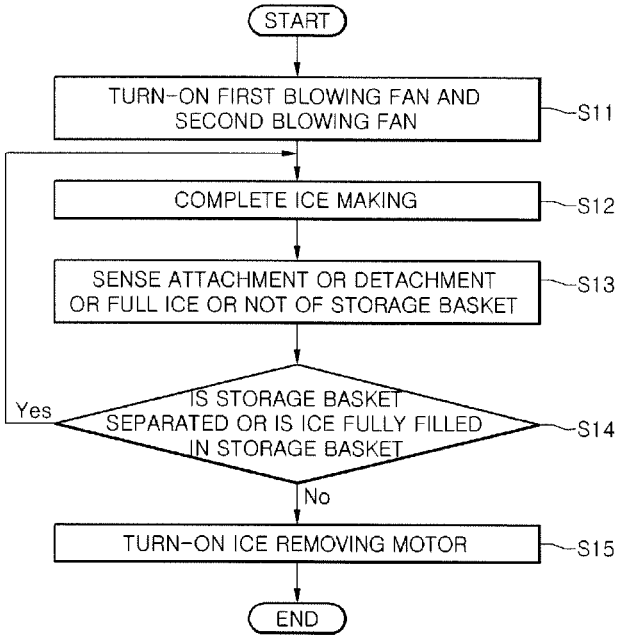
FIGS. 14 and 15 are flowcharts showing a method for controlling a refrigerator.
Figure 15:
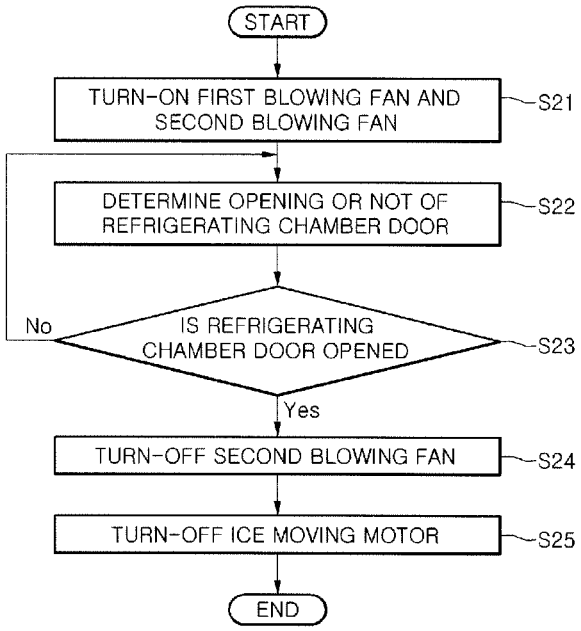

FIGS. 14 and 15 illustrate example methods for controlling the refrigerator. FIG. 14 shows an example method for controlling a refrigerator according to whether the attachment and detachment of the storage basket 210 or ice is fully filled.

The controller 300 performs a control to turn-on the first blowing fan 53 and the second flowing fan 140. Then, the cool air produced in the first heat exchanger 51 is supplied to the freezing chamber 16 through the first blowing fan 53 and the cool air produced in the second heat exchanger 120 is supplied to the ice making unit 100 through the second blowing fan 140 (S11).

In this state, the supply of cool air to the ice making unit 100 is performed for a predetermined time and the ice making at the ice maker 110 can be completed (S12).

When the ice making is completed, the attachment or detachment of the storage basket 210 can be sensed by the sensor 220. Further, the full ice or not of the storage basket 210 can be sensed (S13).

When it is sensed that the storage basket 210 is separated (detached) from the housing 201, the ice removal in the ice maker 110 is not performed and is returned to step S11. Further, even when it is sensed that the storage basket 210 is fully filled, the ice removal in the ice maker 110 can be stopped (S14).

When it is sensed that the storage basket 210 is coupled to the housing 201, the controller 300 performs a control to drive the ice removing motor 115 (S15). When the ice removing motor 115 is driven, ice is separated from the ice maker 110 and is stored in the storage basket 210. Further, even when it is sensed that the storage basket 210 is not fully filled, it can be controlled to perform the ice removal in the ice maker 110 (S15).

FIG. 15 shows an example method for controlling a refrigerator when the refrigerating chamber door 12 is opened.

The first blowing fan 53 and the second blowing fan 140 are turned-on, such that the supply of cool air to the freezing chamber 16 and the ice making unit 100 can be performed (S21).

In this state, the opening or not of the refrigerating chamber door 12 can be determined by the operation of the door switch 70 (S22).

When it is sensed that the refrigerating chamber door 12 is not opened, the turn-on state of the first blowing fan 53 and the second blowing fan 140 is continuously maintained and when it is sensed that the refrigerating chamber door 12 is opened, the second blowing fan 140 is turned-off (S23 and S24).

When the second blowing fan 140 is turned-off, the supply of cool air to the ice making unit 100 is stopped, such that the phenomenon that the cool air is unnecessarily leaked to the outside of the refrigerator through the opened door can be reduced (e.g., prevented).

When the refrigerator door 12 is opened, the ice making unit 100 and the ice storage unit 200 are separated from each other, such that the ice removal in the ice maker 110 should be stopped. Therefore, the ice removing motor 115 is controlled to be turned-off (S25).

Figure 16:
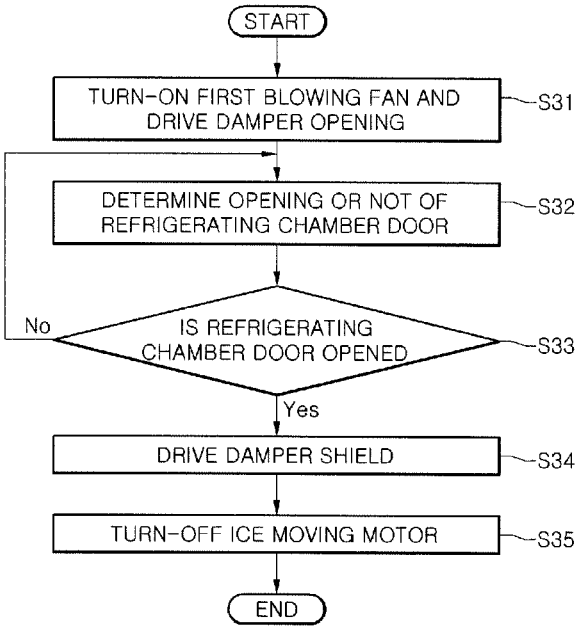
FIG. 16 is a flowchart showing a method for controlling a refrigerator.

FIG. 16 illustrates an example method for controlling the refrigerator. FIG. 16 shows an example method for controlling the damper 90 and the ice removing motor 115 according to the opening of the refrigerating chamber door 12.

In the state where the refrigerating chamber door 12 is closed, the first blowing fan 53 is driven and the damper 90 is opened, such that at least a part of the cool air produced in the first heat exchanger 51 can be supplied to the ice maker 110 through the cooling duct 56 (S31).

In this state, the opening or not of the refrigerating chamber door 12 can be determined by the door switch 70 (S32).

When it is sensed that the refrigerating chamber door 12 is not opened, the driving of the first blowing fan 53 and the opening state of the damper 90 is continuously maintained and when it is sensed that the refrigerating chamber door 12 is opened, the damper 90 shields the cooling duct (S33 and S34).

When the second cooling duct 90 is shielded, the supply of cool air to the ice making unit 100 is stopped, such that the phenomenon that the cool air is unnecessarily leaked to the outside through the opened door can be reduced (e.g., prevented).

When the refrigerator door 12 is opened, the ice making unit 100 and the ice storage unit 200 are separated from each other, such that the ice removal in the ice maker 110 should be stopped. Therefore, the ice removing motor 115 is controlled to be turned-off (S35).

Meanwhile, the case where the controller 300 controls the driving of the ice removing motor 115 according to the attachment or detachment or the full ice or not of the storage basket 210 is similar to described above (see FIG. 14).

With the refrigerator according to the above configuration and operation, the attachment or detachment of the ice storage basket is sensed by the sensor or the switch. In some examples, the ice removing time in the ice maker may be controlled.

In some implementations, the cool air supplied to the ice maker is controlled such that the phenomenon that the cool air is unnecessarily leaked to the outside can be reduced (e.g., prevented). In some examples, when the refrigerator door is opened, the ice removal of the ice maker is stopped such that the phenomenon that ice is discharged to the outside can be reduced (e.g., prevented).

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator, comprising:

a main body that includes a refrigerating chamber and a freezing chamber;

a door coupled to the refrigerating chamber to open and close at least a portion of the refrigerating chamber;

an ice removing motor installed within a groove of the door;

an ice making unit disposed within the refrigerating chamber to produce ice, the ice making unit comprising an ice discharging part to discharge produced ice; and an ice storage unit provided at the door to store ice produced in the ice making unit, the ice storage unit including:

a housing having a receiving space, the housing including a first wall, a second wall opposite to the first wall, and a third wall having an ice receiving part to receive ice discharged from the ice discharge part;

a storage basket drawably received in the receiving space to store ice removed from the ice making unit, the storage basket including a first side portion moving along the first wall, a second side portion moving along the second wall, a third portion provided with a handle, a fourth portion selectively coupled to the door, and a fifth portion having an outlet to discharge ice stored in the storage basket; and a sensing apparatus provided at the housing to sense attachment or detachment of the storage basket, the sensing apparatus including a transmitter mounted to the first wall and a receiver mounted to the second wall; and an interruption member coupled to the first wall or second wall to selectively block signals transmitted from the transmitter to the receiver, the interruption member including a first opening through which the signals pass wherein the first side portion or the second side portion includes a press part to press the interruption member such that the interruption member does not block the signals transmitted from the transmitter to the receiver when the storage basket is received in the receiving space, wherein the storage basket further includes:

a second opening through which the signals passing through the first opening pass an auger that rotates to move ice stored in the storage basket to the outlet; and a rotating shaft coupled to the auger to transfer turning force to the auger, the rotating shaft penetrating the fourth portion of the storage basket, and wherein the rotating shaft is separated from the ice removing motor when the storage basket is drawn out from the housing and is coupled to the ice removing motor when the storage basket is received in the receiving space of the housing.

2. The refrigerator according to claim 1, wherein the housing includes:

a loading part on which the fifth portion of the storage basket is loaded; and a guide rail that is provided on at least one side of the first and second walls to guide movement of the storage basket.

3. The refrigerator according to claim 1, wherein the sensing apparatus includes:

a sensor that is provided on at least a part of the storage basket and senses attachment and detachment of the storage basket; and a contact member that is configured to selectively contact the sensor according to whether or not the storage basket is mounted in the housing.

4. The refrigerator according to claim 1, wherein the ice making unit includes:

an ice maker to store water to produce ice; and a controller configured to selectively drive the ice removing motor based on the output from the sensing apparatus that indicates attachment or detachment of the storage basket.

5. The refrigerator according to claim 1, wherein the refrigerating chamber further includes a door switch provided at a frontal side thereof to contact the door.

6. The refrigerator according to claim 5, wherein the ice making unit includes:

an ice maker to store water to produce ice; and a controller configured to selectively drive the ice removing motor based on output from the door switch that indicates whether the door is oriented in an open position or oriented in a closed position.

7. The refrigerator according to claim 1, further comprising:

a first heat exchanger that is provided at one side of the freezing chamber and configured to produce cool air;

a first blowing fan that moves at least a part of cool air produced by the first heat exchanger to the ice making unit; and a cooling duct that extends from the freezing chamber to the ice making unit to guide the part of cool air moved by the first blowing fan to the ice making unit.

8. The refrigerator according to claim 1, further comprising:

a first heat exchanger configured to produce cool air supplied to the freezing chamber; and a second heat exchanger that is provided at the ice making unit and configured to supply cool air to the ice making unit to enable making of ice.

9. The refrigerator according to claim 1, wherein the freezing chamber is disposed below the refrigerating chamber and the freezing chamber and the refrigerating chamber are partitioned by a barrier.

10. The refrigerator according to claim 1, wherein the ice making unit is disposed at the door.

* * * * *